US010287863B2

(12) United States Patent
Ayasse

(10) Patent No.: US 10,287,863 B2
(45) Date of Patent: May 14, 2019

(54) INTERMITTENT FRACTURE FLOODING PROCESS

(71) Applicant: IOR Canada Ltd., Calgary (CA)

(72) Inventor: Conrad Ayasse, Calgary (CA)

(73) Assignee: IOR Canada Ltd., Calgary, Alberta ( * ) Notice: Subject to any disclaimer, the term of this patent is extended or adjusted under 35 U.S.C. 154(b) by 354 days.

(21) Appl. No.: 15/422,060

(22) Filed: Feb. 1, 2017

(65) Prior Publication Data

US 2017/0226834 A1 Aug. 10, 2017

(30) Foreign Application Priority Data

Feb. 5, 2016 (CA) ..... 2920201

(51) Int. Cl.

| | |
|---|---|
| ***E21B 34/12*** | (2006.01) |
| ***E21B 43/18*** | (2006.01) |
| ***E21B 43/20*** | (2006.01) |
| ***E21B 34/06*** | (2006.01) |
| ***E21B 43/16*** | (2006.01) |
| ***E21B 43/26*** | (2006.01) |
| ***E21B 43/40*** | (2006.01) |
| *E21B 34/00* | (2006.01) |

(52) U.S. Cl.

CPC ..... *E21B 43/18* (2013.01); *E21B 34/06* (2013.01); *E21B 34/12* (2013.01); *E21B 43/166* (2013.01); *E21B 43/168* (2013.01); *E21B 43/20* (2013.01); *E21B 43/26* (2013.01); *E21B 43/40* (2013.01); *E21B 2034/007* (2013.01)

(58) Field of Classification Search

CPC ..... E21B 34/06; E21B 34/12

USPC ..... 166/263

See application file for complete search history.

(56) References Cited

U.S. PATENT DOCUMENTS

| | | | | |
|---|---|---|---|---|
| 8,763,689 B2 * | 7/2014 | Heijnen | ..... | E21B 34/14 166/205 |
| 2014/0262240 A1 * | 9/2014 | Boone | ..... | E21B 47/00 166/250.01 |

FOREIGN PATENT DOCUMENTS

| | | |
|---|---|---|
| CA | 2855417 C | 1/2015 |
| CA | 2885146 A1 | 1/2016 |
| WO | 2016000068 A1 | 1/2016 |

* cited by examiner

*Primary Examiner* — William D Hutton, Jr.
*Assistant Examiner* — Ashish K Varma
(74) *Attorney, Agent, or Firm* — D. Doak Horne

(57) ABSTRACT

A pressure-up blow-down method for recovering oil from an underground hydrocarbon formation, comprising the steps of: injecting an injection fluid into alternatingly-spaced multiple-induced fractures which extend radially outwardly and along a horizontal portion of a wellbore in the formation; ceasing injection of said injection fluid; recovering to surface oil which flows from remaining of the multiple induced fractures into the wellbore; and successively repeating the foregoing steps one or more times. Gas preferentially is initially used as the injection fluid and after one successive iteration water is then used. A sliding sleeve or sleeves which may be selectively slid open and closed within the wellbore in accordance with the method to allow and prevent, at various time periods in the method, fluid communication with fluid injection fractures and oil production fractures.

29 Claims, 13 Drawing Sheets

INTERMITTENT FRACTURE FLOODING PROCESS

CLAIM OF BENEFIT OF PRIORITY

This application claims the benefit of priority from Canadian Patent Application Serial No. 2,920,201 filed Feb. 5, 2016, which is hereby incorporated by reference in its entirety.

FIELD OF THE INVENTION

The present invention relates to a fluid-drive hydrocarbon recovery process, and more particularly to an fluid drive recovery process which uses fluid injection intermittently and in alternating fractures that have been created in a subterranean hydrocarbon formation, to drive oil in the formation to the remaining adjacent alternating fractures, for subsequent collection from such oil producing fractures and production to surface.

BACKGROUND OF THE INVENTION

Commonly assigned Canadian Patent 2,855,417 published Jan. 4, 2015 and WO 2016/000068 A1 (corresponding to CA 2,885,146 published Jan. 2, 2016), each of which is expressly incorporated herein by reference in their respective entireties, teach various procedures to exploit induced fractures in multi-fractured horizontal wells, used for, but not limited to, the improved production of oil from tight reservoirs or any consolidated reservoir matrix.

CA '417 and '146 teach the utilization of the fractures as injection or production conduits attached to a horizontal well so that injection fluids can be selectively distributed in a continuous manner to alternate fractures with the remaining fractures employed as production fractures. By eliminating communication between injection and production fractures within the horizontal wellbore, injected fluids are forced to flow through the reservoir matrix from the injection fractures to the production fractures.

One embodiment taught in the above publications teaches the use of a long tubing from the surface running through an isolation actuatable packer placed between the two fractures nearest the toe of the horizontal well. Injectant, which could be but is not limited to water, hydrocarbon gas, CO2 or mixtures thereof, is conveyed continuously down the long tubing and enters the fracture furthermost from the heel of the horizontal well (i.e. at the toe thereof) and penetrates the formation matrix pushing oil towards the adjacent fracture in the direction of the heel and thence into the annulus of the horizontal well, whence it is conveyed to the surface. Once the injectant appears at the surface in sufficient quantity, the packer is deactuated and is moved one fracture closer to the heel of the horizontal well where it is actuated and continuous injection is resumed. The process continues until the entire reservoir volume delineated by the fractures has been flooded with the injectant. This process has modest cost, but suffers from only a single segment of the reservoir being flooded at one time.

CA 417' and '146 also teach the use of dual-channel tubing or pipe placed in the well liner and having independent flow areas, for example a single tubing or pipe with an internal divider that that creates independent internal channels or a concentric tubing or pipe having a central channel and an annular channel. The tubing or pipe contain apertures proximate each fracture and an isolation packer around the tubing or pipe between each fracture to prevent communication between the channels within the wellbore. In a continuous process, injectant is conveyed into approximately alternate fractures and oil produced from the other fractures. Being continuous, this process produces higher oil rates, but also has higher capital costs because of the need for specialized tubing or pipe.

Given the current extremely low oil price (<$30/bbl) and the high cost of drilling and multi-fracturing long and deep horizontal wells (approximately $8-million/well) there is a need for a process with low capital cost that can revive existing multi-fractured wells. The rapid decline rate in tight light oil reservoirs such as the Bakken and Eagle Ford wells can be 70% in the first year and 50% in the second year, however, given sufficient secondary oil recovery, companies could cease drilling new wells without a fall in overall oil production. These existing wells are largely past their 2-year primary recovery prime, however 90-95% of the original oil-in-place is still there.

Other than Fracture Flooding™, as described in the above-referenced documents, the prospects for secondary oil recovery in light tight oil reservoirs are bleak. Some operators have attempted water flooding or gas flooding from parallel multi-fractured wells, however, communication between fractures short-circuits the flow patterns, undermining reservoir sweep efficiency. Re-fracturing is expensive and has provided inconsistent results. The process of the present invention holds promise to solve all the major economic and engineering problems concerning secondary oil recovery from light tight oil reservoirs: low capital cost, higher and sustained oil production rates and higher oil recovery factor.

SUMMARY OF THE INVENTION

The method of the present invention inter alia differs from the prior art in that it is an intermittent process that entails periodic re-pressurizing of the reservoir to rejuvenate recovery rates, using fluid injection in alternately-spaced fluid injection fractures, with oil production occurring from remaining alternate (and immediately adjacent) oil production fractures, thereby in such manner most directly applying a fluid drive to the formation to sweep the formation of oil and direct it to the adjacent alternately spaced oil production fractures. Such process is herein referred to as the Fracture Flooding INT™ process or Intermittent Fracture Flooding.

Many of existing multi-fractured (i.e. already completed) wells are lined and cemented, and have sliding sleeves already located in the wellbore liner to be able to isolate each fracture.

The present process, where used on an existing well, allows advantage to be taken of this existing equipment, and no other equipment is needed downhole. Accordingly, the method of the present invention may be utilized for a well that has been freshly drilled and completed, or alternatively can be used on a well that is many years into oil production.

In the method of the present invention, for new wells, sliding sleeves may be provided at locations along the wellbore where the wellbore is in communication with oil production fractures, to allow such sleeves to isolate/shut in such oil production fractures during a fluid-injection phase of the present method.

In an optional step, where a single conduit/wellbore is used to both inject fluid and produce oil from the wellbore, an additional step may be added to the method whereby the wellbore may be first flushed with injectant prior to the injectant phase, to thereby produce any remaining oil in the wellbore to surface so that such residual oil will not otherwise later enter the reservoir during the fluid injection phase and detrimentally affect relative permeability of the injectant, to say nothing of the loss of the opportunity to recover such residual oil to surface.

As an initial step/phase in the method, fluid injectants are conveyed into an open wellbore liner and enter alternatingly-spaced open fractures (the fluid injection fractures) where such fluid serves to pressurize the formation and drive oil laterally away from such fluid injection fractures towards adjacent juxtaposed oil production fractures. After a short period, due to such fluid injection which might last a few months, the reservoir will become uniformly re-pressured to the native reservoir pressure or higher. Thereafter, the fluid injection fracture sleeves may be closed, while the remaining sleeves opposite the oil production fractures are then opened. Fluids draining into the wellbore from the oil production fractures are then conveyed to the surface. The oil production period is substantially longer than the injection period, lasting up to 2-years or longer. This completes the first stage of the Intermittent Fracture Flooding process.

Successive iterations/stages of the method of the present invention may be conducted as desired, but preferably, after the initial iteration of the above method, the wellbore is flushed of oil by briefly producing the injectant fractures to the surface, prior to recommencing injectant injection.

The present process therefore differs significantly from the traditional Cyclic or 'Huff and Puff' or Pressure-up-Blow-down processes wherein the near-well region becomes alternately saturated with oil and injectant, and during the injection stage oil is pushed away from the wellbore.

Conversely and by way of contrast, injectant enters the matrix/formation through a dedicated channel—namely the fluid injection fractures, and oil is preferentially produced through separate dedicated channels—namely the oil production fractures (albeit the oil may be produced to surface through the same wellbore as the fluid is injected but this is not detrimental to the reservoir mechanics). In such manner the detrimental effect on fluid injectivity and productivity of the formation caused by decreased oil and water relative permeability when multiple phases are mixed in the reservoir matrix is thereby eliminated.

The method of the present invention and such above particular advantages are thus particularly preferred in tight rocks where its advantages as described herein over the aforesaid methods are particularly acute.

Accordingly, in order to realize the above advantages and achieve some of the advantages over the above methods, in a first broad embodiment of the method of the present invention such method relates to a method for recovering oil from an underground hydrocarbon formation having a lined wellbore therein, said hydrocarbon formation having multiple induced fractures spaced along a portion of a length of said lined wellbore and extending radially outwardly therefrom, by intermittently injecting fluid into alternately-spaced of said fractures and producing hydrocarbons including oil from remaining of said multiple induced fractures, comprising the steps of:

injecting an injection fluid into said alternatingly-spaced of said multiple-induced fractures and continuing to do so for a period of time to thereby pressure-up the formation;

(ii) ceasing injection of said injection fluid;

(iii) recovering to surface oil which flows from said remaining of said multiple induced fractures into said lined wellbore at locations of contact of said remaining of said multiple induced fractures with said lined wellbore; and (iv) successively additionally repeating the foregoing steps one or more times.

The above method is typically repeated until recovery of said oil in step (iii) ultimately drops below acceptable production rates and quantities.

The portion of the length of the wellbore in the methods disclosed herein may be vertical, slant or horizontal, but preferred embodiments the aforesaid portion of the length of the wellbore is substantially horizontal.

In a refinement of such above method, the method comprises the further step of flushing oil remaining in the lined wellbore from the lined wellbore, wherein said flushing of said oil is accomplished by briefly producing said injected fluid to surface prior to injecting said injection fluid into the alternately spaced fluid injection fractures in step (i).

Specifically, such above method may further be modified by adding after step (vi) but prior to injecting fluid into said alternating multiple inducted fractures [i.e. fluid injection fractures) in step (i)], the step of flushing oil remaining in the lined wellbore from the lined wellbore by draining injection fluid remaining in said fluid injection fractures back into said wellbore, and briefly producing said injection fluid and any remaining oil in said wellbore to surface.

Alternatively, such method may comprise the further step of flushing oil remaining in said lined wellbore by injecting the injection fluid at a toe of the horizontal portion of the wellbore via a tubing in said lined wellbore extending to said toe thereof, and producing same to surface.

For purposes of nomenclature, alternatingly-spaced multiple induced fractures along the portion of the length of the wellbore that are injected with fluid are referred to as fluid injection fractures.

Similarly, remaining (alternately spaced) multiple induced fractures from which oil flows into the lined wellbore at locations of contact of such multiple induced fractures and said lined wellbore are hereinafter referred to as oil production fractures.

In a further refinement of the above method, a sliding sleeve or sliding sleeves may be provided at the location of contact of the oil production fractures and the lined wellbore to at different times allow and prevent fluid communication of the oil production fractures with the lined wellbore. Accordingly, in such further refinement the present invention, the method comprises an intermittent pressure-up, blow-down method to recover oil from an underground hydrocarbon formation, said hydrocarbon formation having multiple induced fractures spaced along and contacting a portion of a length of a lined wellbore situated in said hydrocarbon formation, said multiple induced fractures extending substantially radially outwardly from said lined wellbore, comprising the steps of:

(i) closing, via a sliding sleeve or sleeves, alternatingly-spaced of said multiple induced fractures at locations of contact thereof with said lined wellbore to form a plurality of oil production fractures in the formation which are shut-in from said lined wellbore;

(ii) injecting an injection fluid into the lined wellbore and causing said injection fluid to flow into remaining of said multiple induced fractures, for a period of time to thereby pressure-up the formation;

(iii) subsequently opening said sliding sleeve or sleeves at locations of fluid communication of said oil production fractures with said lined wellbore and allowing fluid communication between said oil production fractures and an interior of said lined wellbore;

(iv) recovering to surface, and for a period of time, oil which flows into said lined wellbore at locations of contact of said lined wellbore with said oil production fractures; and (v) successively repeating each of steps (i)-(iv) one or more times.

Again, such above method is typically repeated until recovery of said oil in step (iv) ultimately drops below acceptable production rates and quantities.

Again, in preferred embodiments, the portion of the length of the lined wellbore in the above method is substantially horizontal.

In a preferred embodiment of the above refinement of the method of the present invention, a further step is included, namely the further step, of flushing oil remaining in said lined wellbore from the lined wellbore, wherein said flushing of said oil is accomplished by briefly producing said injected fluid to surface prior to injecting fluid into fluid injection fractures in step (ii).

Specifically, such above method may further be modified by adding, after step (v) but prior to injecting said injection fluid in step (ii), the step of flushing oil remaining in the lined wellbore from the lined wellbore by draining injection fluid remaining in said fluid injection fractures back into said wellbore, and briefly producing said injection fluid and any remaining oil in said wellbore to surface.

Alternatively, such above method may comprise the further step, after step (v) but prior to again injecting said injection fluid in step (ii), of flushing oil remaining in said lined wellbore by injecting the injection fluid at a toe of the horizontal portion of the wellbore via a tubing in said lined wellbore extending to said toe thereof, and producing same to surface, to thereby avoid such residual oil otherwise being inadvertently (an undesirably) entrained in the injected fluid and re-injected into the formation.

In a further refinement of the method of the present invention, a sliding sleeve or sleeves may be provided at the location of contact of both the fluid production fractures and the oil production fractures with the lined wellbore, and such sleeve or sleeves operated in the following manner.

Specifically, in a further refinement of the method of the present invention, such method comprises an intermittent pressure-up, blow-down method to recover oil from an underground hydrocarbon formation having a lined wellbore and having multiple induced fractures extending radially outwardly from said lined wellbore and longitudinally spaced along a portion of a length of said wellbore, comprising the steps of:

(i) closing, via a sliding sleeve or sleeves, alternatingly-spaced of said multiple induced fractures at locations of contact thereof with said lined wellbore to form a plurality of oil production fractures which are shut-in from said lined wellbore;

(ii) opening, via a sliding sleeve or sleeves, remaining of said multiple induced fractures, at locations of contact thereof with said lined wellbore to form a plurality of fluid injection fractures;

(iii) injecting an injection fluid into the lined wellbore and causing said injection fluid to flow into said remaining of said multiple induced fractures, for a period of time, to thereby pressure-up the formation;

(iv) closing said sliding sleeve or sleeves wellbore at locations of contact of said fluid injection fractures with said lined wellbore, and preventing fluid communication between said fluid injection fractures and an interior of said lined wellbore;

(v) opening said sliding sleeve or sleeves at locations of contact of said oil production fractures with said lined wellbore, and allowing fluid communication between said oil production fractures and an interior of said lined wellbore;

(vi) recovering to surface, and for a period of time, oil which flows into said lined wellbore at locations of contact of said lined wellbore with said oil production fractures; and (vii) successively repeating each of steps (i)-(v) one or more times.

Again, such above method is typically repeated until recovery of said oil in step (vi) ultimately drops below acceptable production rates and quantities.

Again, in preferred embodiments, the portion of the length of the lined wellbore in accordance with the above method is horizontal.

In a refinement of such above method, such method comprises the further step of flushing oil remaining in said lined wellbore from the lined wellbore, wherein said flushing of said oil is accomplished by briefly producing said injected fluid to surface after shutting in the oil production fracture in step (i) and prior to shutting in the fluid injection fractures in step (iv) above.

Specifically, such above method may further be modified by adding a step, after step (vi) but prior to shutting in the fluid injection fractures in step (iv), of flushing oil remaining in the lined wellbore from the lined wellbore by draining injection fluid remaining in said fluid injection fractures back into said wellbore and briefly producing said injection fluid and any remaining oil in said wellbore to surface.

Alternatively, such above method may comprise the further step after step (vi) of flushing oil remaining in said lined wellbore by injecting the injection fluid at a toe of the horizontal portion of the wellbore via a tubing in said lined wellbore extending to said toe thereof, and briefly producing same to surface.

The purpose of the injected fluid in the method of the present invention is as a driving/sweeping fluid to drive oil and hydrocarbons within the formation to the alternately-spaced oil production fractures and thence into the lined wellbore for recovery to surface. It is not necessary that the injected fluid be miscible in oil, but having the injected fluid miscible in oil will advantageously reduce the viscosity thereof and increase the flowability thereof, thereby increasing oil recovery rates from the formation albeit at the slight increased expense of using a fluid miscible in oil, which fluids include, but are not limited to, fluids such as naptha, diesel, gases which are extracted from oil produced by the present method, carbon dioxide, and other diluents or solvents.

Where a sliding sleeve or sleeves are utilized to open and close the oil production fractures and/or the fluid injection fractures along the wellbore, the step of opening (or closing) the sliding sleeve or sleeves may be carried out by a number of methods, such as:

(i) using an actuation tool inserted on the end of coil tubing and actuated via pressure supplied to the tool via the coil tubing;

(ii) using existing fluid-actuated sleeves which have a piston which when pressurized fluid is supplied to the sleeve the piston forces the sleeve to move; or (iii) using ball-actuated sleeves, such as those commercially sold by Packers Plus of Calgary, Alberta, Canada and others as are known in the art, may be used to open or close the sliding sleeves.

As regards ball-actuated sleeves, as described for example in Canadian Patent 2,412,072 a ball may be pumped down the wellbore using injection fluid pressure, which ball engages and slides a respective sleeve to an new (open or closed) position and thereafter disengages therefrom and thereafter progresses down-wellbore to similarly open/close additional downhole sleeves. The ball may be dissolved and the sleeves closed by withdrawing the pumped fluid, with or without the ball, from the wellbore. Thereafter, to successively then re-close (or re-open) the selected sleeves, such may be carried out by insertion in wellbore of an actuation tool at the distal end of coil tubing. The actuation tool is typically inserted to the distal end (toe) of the wellbore. Upon actuation of the actuator tool at the end of the coil tubing typically by supply of a pressurized fluid to the coil tubing and the tool at the end of the coil tubing, the tool will be actuated to then be able to releasably engage a selected sleeve or sleeves, and movement of the coil and affixed actuation tool uphole causes displacement of said selected sleeve or sleeves to a position so as to re-open (or re-close) the sleeves.

Other known and commonly employed methods of selectively actuating sliding sleeves so as to successively open or close said sleeve or sleeves will now occur to persons of skill in the art. Such alternative methods for actuating the sliding sleeves are likewise contemplated for use in the method of the present invention, In accordance with methods herein, the injection fluid may be a gas.

Alternatively, or in addition, the injection fluid may be a gas selected from the group of gases comprising natural gas, gases contained within and obtained from the produced oil, $CO_2$, and mixtures thereof.

In a further embodiment, where the injection fluid is a gas, such gas is miscible in oil.

In addition, where the injection fluid is a gas, the injection fluid may be obtained from a gaseous fraction recovered from the produced oil, and may be recycled/re-used in the method of the present invention to assist in increasing the motility of oil in the formation.

In a preferred embodiment, the gas fraction obtained from the produced oil is obtained by subjecting the produced oil when produced to surface to increased temperature and/or reduced pressure to thereby flash a small portion of volatile gaseous components within said produced oil, for subsequent use as the injection fluid in one or more of the methods of the present invention.

In a further or alternative embodiment the injected fluid is a gas which is entrained in, or produced from, from the produced oil, and is enriched in C2-C5 components. Such higher-carbon gaseous components/compounds assist when injected into the formation as the injected fluid, in increasing the motility of oil in the formation and thereby better sweeping such oil to the oil production fractures for subsequent collection and production to surface.

In a still-further embodiment, oil which is produced in accordance with one or more of the methods disclosed herein is heated and used to provide additional gaseous components for the injected fluid.

The injected fluid may be water, with or without additives, and/or may comprise both water and gas.

The above methods may be used for previously-unworked hydrocarbon formations, or hydrocarbon formations which have been worked but never previously been fracked to produce multiple induced fractures along the length of a wellbore therein.

Alternatively, the methods of the present invention may be used on hydrocarbon formations which have been previously worked and fracked, but which have not previously had the methods of the present invention applied to them. Stated otherwise, the methods herein may be applied when working of a hydrocarbon formation is first commenced or at any time in a lifecyle of the working and completion of a hydrocarbon reservoir.

With any of the above methods, the period of time for said injecting of said injection fluid and pressuring up said formation will typically need to be carried out over a period extending from one day to 1 year, depending on formation porosity, permeability, and general length of fractures which are created in a formation.

Likewise, with any of the above methods, the period of time for recovering of said produced fluids (oil) will often need to be carried out over a period extending from one month to 10 years, considering typical formation porosity, permeability, and formation temperatures and pressures as often encountered, exemplars of which are specifically set out later in this specification.

In all embodiments of the present method, the fluid pressure of the injected fluid when injected from the lined wellbore is preferably equalized over its length to thereby uniformly inject injection fluid at a substantially constant pressure over the length of a horizontal portion the lined wellbore.

One manner of achieving equal pressure application of injection/driving fluid to the fluid injection fractures is to provide the wellbore liner with a perforated tubing inserted within and extending substantially over a horizontal length of said portion of the wellbore, and having perforation patterns or sizes therein configured so as to equalize fluid pressure applied to said fluid injection fractures along the portion of the length of the lined wellbore. Specifically, for example, the cross-sectional area of apertures in said perforated tubing in said wellbore or the cross-sectional area of apertures in said wellbore liner (which apertures are each in fluid communication with said fluid injection fractures) may be made larger in cross-sectional area at the distal (toe) end of the wellbore as opposed to at the heel or more proximate the surface, to account for the reduced fluid pressure of the injected fluid at the toe of the wellbore as opposed to the heel, so that the resultant pressure differential applied by the injected fluid will be equalized.

Similarly, one manner of achieving equal pressure drawdown of recovered oil from the various oil production fractures along the length of a wellbore is to provide the wellbore liner with a perforated tubing inserted within and extending substantially over a horizontal length of said portion of the lined wellbore, and having perforation patterns and/or sizes therein configured so as to equalize fluid pressure of fluid draining into said wellbore over said length of said lined wellbore, to thereby allow uniform flow (recovery) rates from the individual oil production fractures. Specifically, for example, the cross-sectional area of apertures in said perforated tubing in said wellbore or the cross-sectional area of apertures in said wellbore liner (which apertures are each in fluid communication with said oil production fractures) may be made larger in cross-sectional area at the distal (toe) end of the wellbore as opposed to at the heel or more proximate the surface, to account for the more reduced pressure differential at such location as compared to the heel of the wellbore (where such oil is being withdrawn to surface typically under a negative (suction) pressures thus giving rise to an increased pressure differential that the oil production fractures are exposed to at the heel), so that the resultant pressure differential applied at each oil production fractures at both the toe and heel is more approximately equal.

The foregoing summary of the invention does not necessarily describe all features of the invention. For a complete description of the invention, reference is to further be had to the drawings and the detailed description of some preferred embodiments, read together with the claims.

BRIEF DESCRIPTION OF THE DRAWINGS

Further advantages and other embodiments of the invention will now appear from the above along with the following detailed description of the various particular embodiments of the invention, taken together with the accompanying drawings each of which are intended to be non-limiting, in which:

FIG. 14 is a single combined series of graphs comparing oil recovery factor as a function of time for a hydrocarbon formation, for:

a) continuous water Fracture Flooding (prior art);
b) continuous gas Fracture Flooding (prior art);
c) primary oil recovery (prior art);
d) Intermittent Fracture Flooding in accordance with a the method of the present invention, using gas only as the injection fluid;
e) Intermittent Fracture Flooding for the first stage, then Intermittent water Fracture Flooding; and
f) Intermittent Fracture Flooding using only water as the injection fluid.

In obtaining each of the aforementioned results a)-e), two (2) years of primary production were undertaken, followed by [with the exception of curve (c)] with injection of gas or water, as the case may be, for a period of 4 months, continuously or intermittently, as the case may be.

DETAILED DESCRIPTION OF SOME PREFERRED EMBODIMENTS

Figure 1:
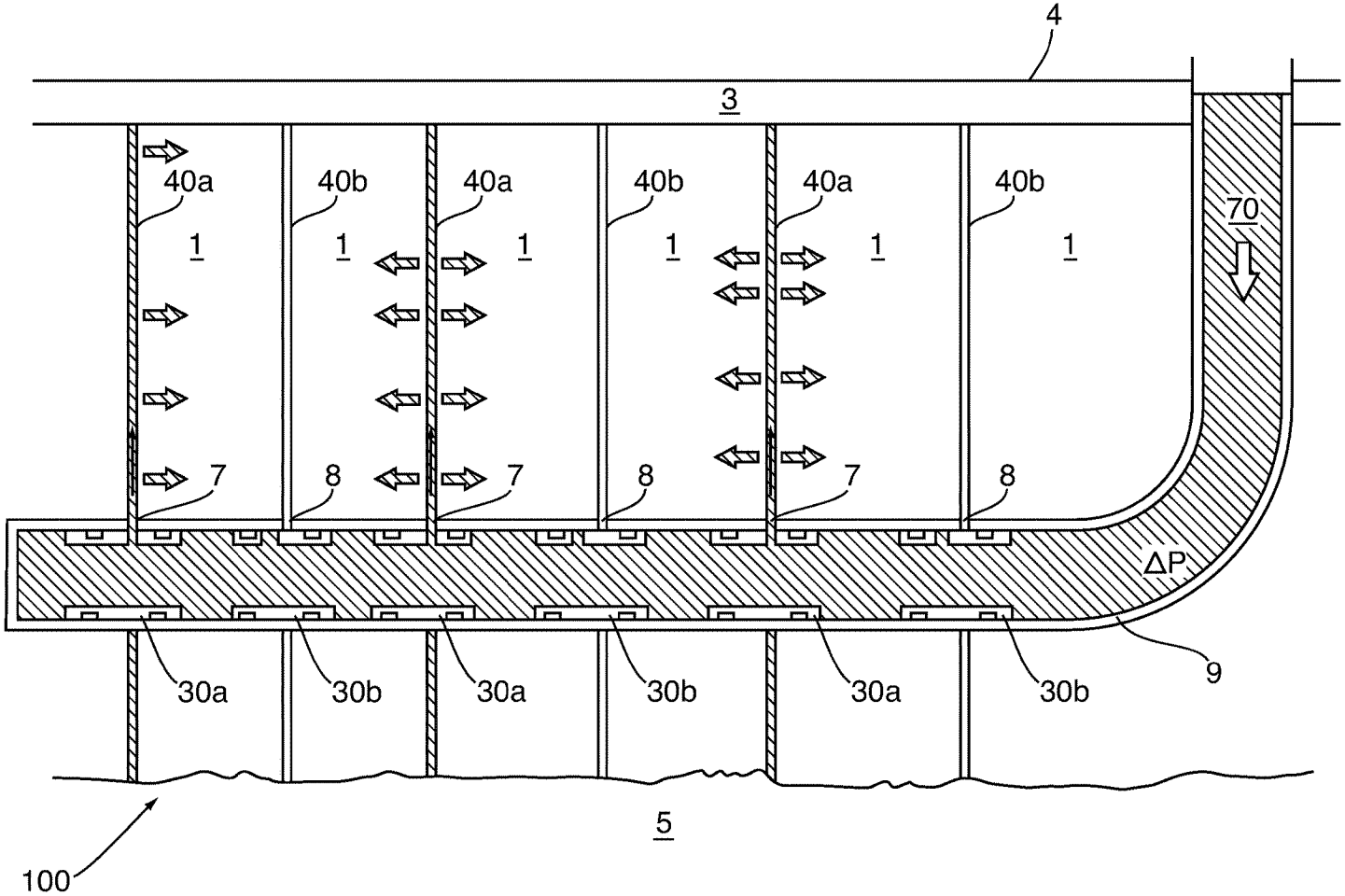
FIG. 1 is a schematic diagram showing the initial step in one embodiment of the Intermittent Fracture Flooding process of the present invention, where fluid communication between the wellbore and the alternatingly-spaced multiple induced fluid injection fractures has initially been established, and fluid communication between alternatingly-spaced fluid production fractures and the wellbore has been prevented/shut-in by movement of associated sliding sleeves within the wellbore.
Figure 2:
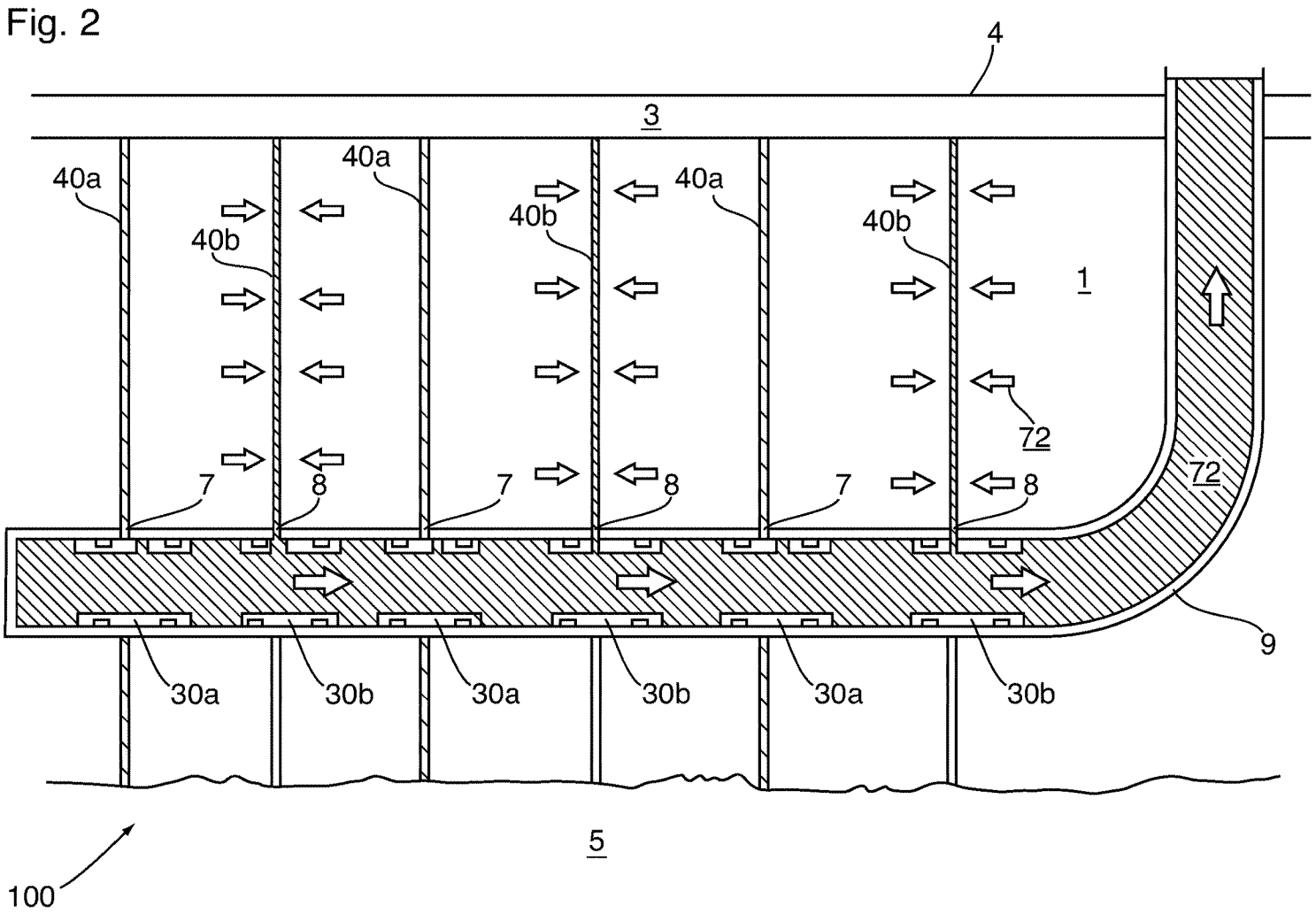
FIG. 2 is a schematic diagram depicting a subsequent step in the Intermittent Fracture Flooding process of FIG. 1, wherein communication between the wellbore and the alternatingly-spaced multiple induced oil production fractures is established, and fluid communication between alternatingly-spaced fluid injection fractures and the wellbore is prevented/shut-in, again by movement of sliding sleeves in the wellbore.

FIG. 1 shows a schematic diagram of an initial step, and FIG. 2 a subsequent step, of in one embodiment of the intermittent pressure-up blow-down method 100 of the present invention for recovering oil from an underground hydrocarbon formation 1 having a lined wellbore 9 therein.

Figure 3:
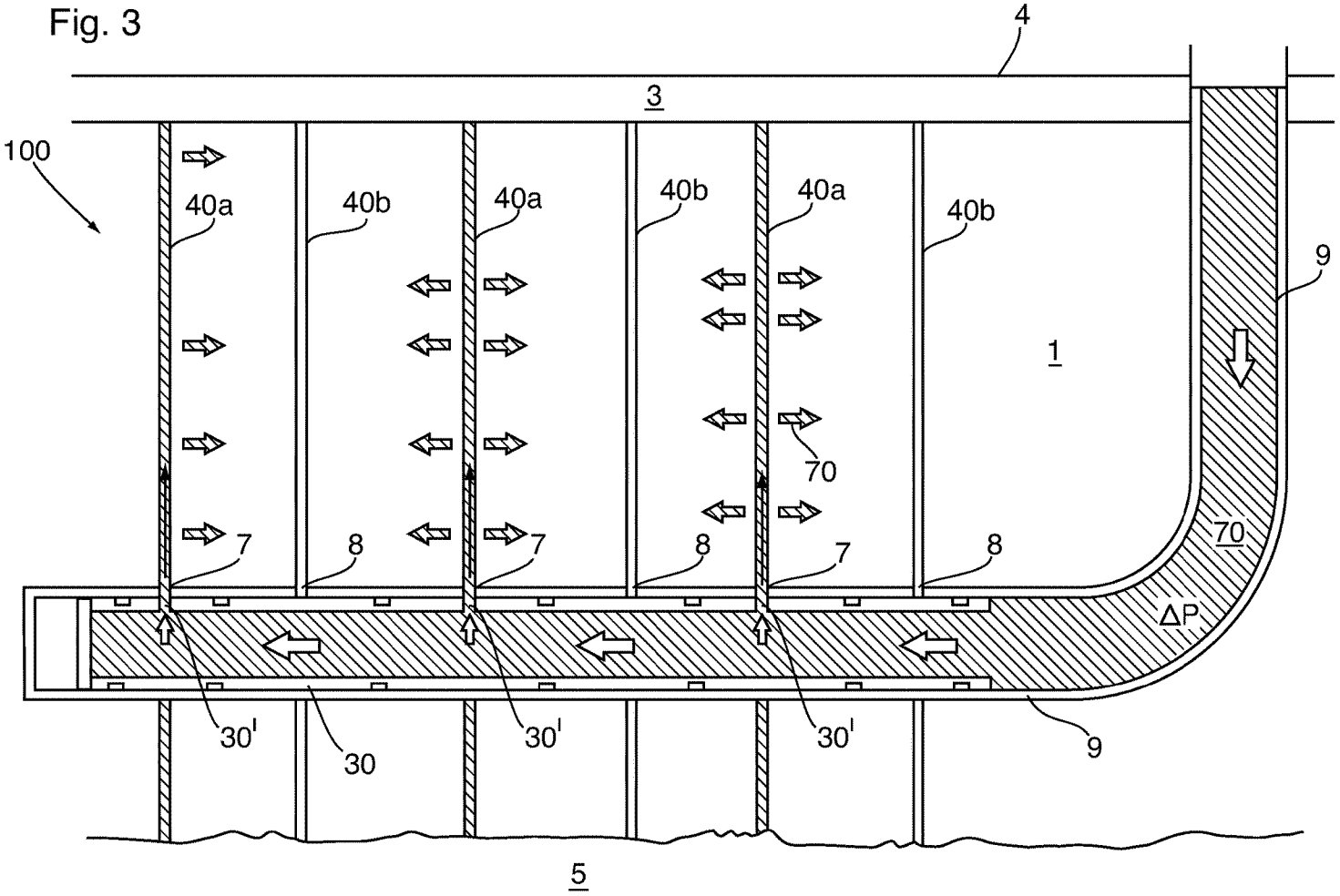
FIG. 3 is a schematic diagram showing of an initial step in a second embodiment in the Intermittent Fracture Flooding process of the present invention, wherein communication between the wellbore and the alternatingly-spaced multiple induced fluid injection fractures is established, and fluid communication between alternatingly-spaced oil production fractures and the wellbore is prevented, by sliding movement of a single sliding sleeve situated at the respective locations of contact of all of the alternatingly-spaced fluid injection fractures and oil production fractures along the wellbore.
Figure 4:
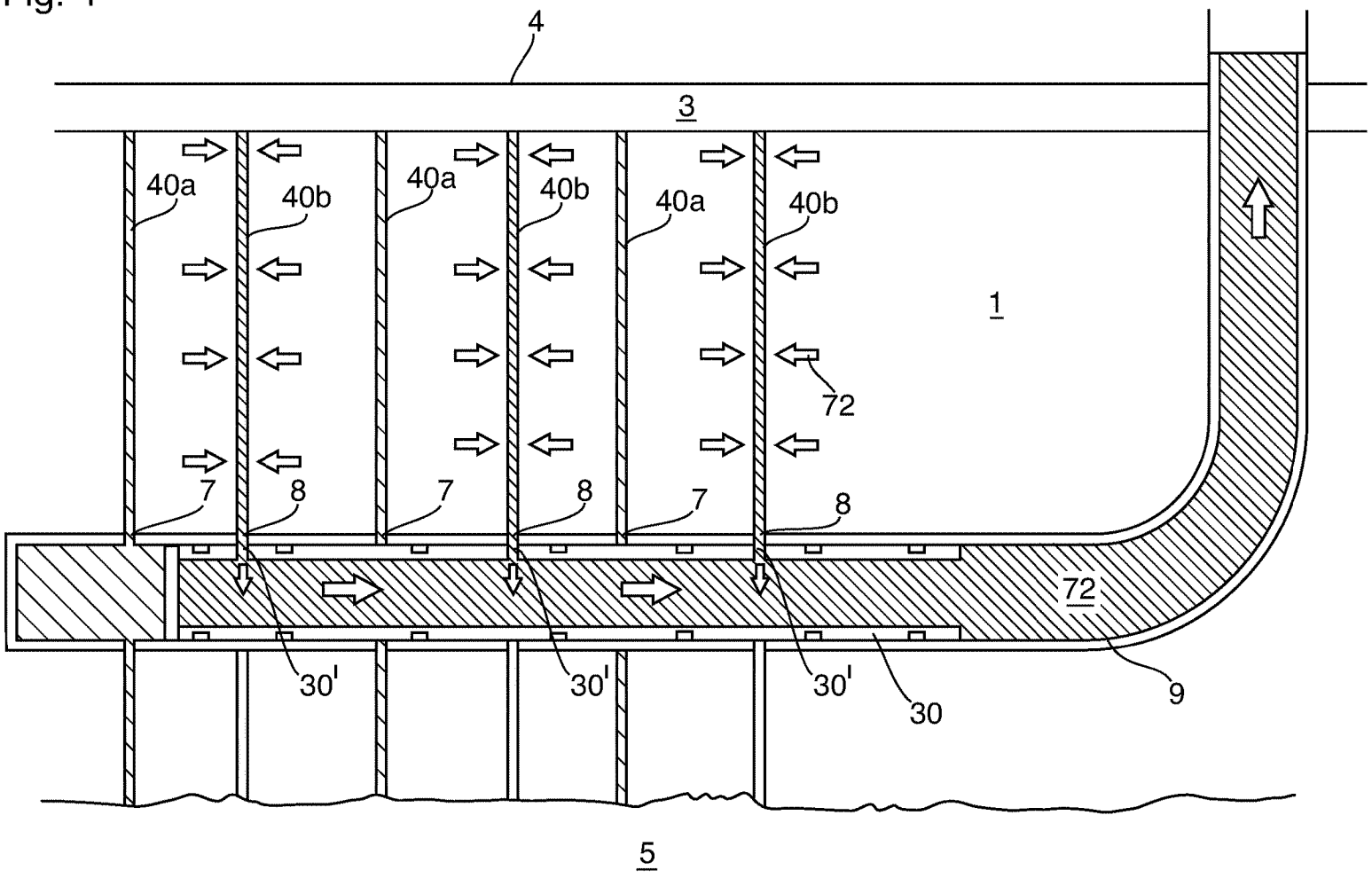
FIG. 4 is a schematic diagram depicting a subsequent step in the Intermittent Fracture Flooding process of FIG. 3, wherein communication between the wellbore and the alternatingly-spaced multiple induced oil production fractures is established, and fluid communication between alternatingly-spaced fluid injection fractures and the wellbore is prevented/shut-in, again by movement of the single sliding sleeve in the wellbore.

FIG. 3 similarly show a schematic diagram of an initial step, and FIG. 4 a subsequent step, of another embodiment of the intermittent pressure-up blow-down method 100 of the present invention.

In all embodiments, method 100 of the present invention is adapted to be worked in a hydrocarbon formation 1, namely a hydrocarbon-bearing deposit 1 typically situated between an upper non-hydrocarbon-containing layer 3, and a lower non-hydrocarbon-containing layer 5 typically consisting of cap rock. Hydrocarbon formation 1 may have a pre-existing wellbore 9 or a newly-drilled lined wellbore 9, and has such formation 1 has been fractures along a portion (preferably but not necessarily a horizontal portion) of the wellbore 9 been completed by any of the known hydraulic fracturing methods so as to have created multiple induced fractures 40*a*, 40*b* spaced along a portion of a length of wellbore 9 having liner 10 therein. Multiple induced fractures 40*a*, 40*b* extend radially outwardly from such lined wellbore 9.

In the embodiment of the method shown in FIGS. 1 & 2, a series of sliding sleeves 30*a*, 30*b* are provided installed along a portion of the length of a lined wellbore 9, namely along the wellbore casing.

An actuator tool, as commonly known in the art (not shown), may be inserted down the wellbore 9 at the end of coil tubing (not shown) so as to initially actuate/move sliding sleeves 30*a* to an open position. Alternatively sliding sleeves 30*a* may be initially installed along lined wellbore 9 in an open position when such wellbore casing is inserted in the well, to initially allow fluid communication between wellbore 9 and fluid injection fractures 40*a*.

Similarly, as regards sliding sleeves 30*b* which regulate fluid communication between wellbore 9 and oil production fractures 40*b*, such sliding sleeves 30*b* may be initially installed along lined wellbore 9 in a closed position when such wellbore casing is inserted in the well, to initially prevent fluid communication between wellbore 9 and oil production fractures 40*b*, and may be subsequently opened when desired by the insertion downhole of an actuation tool as discussed.

Figure 8:
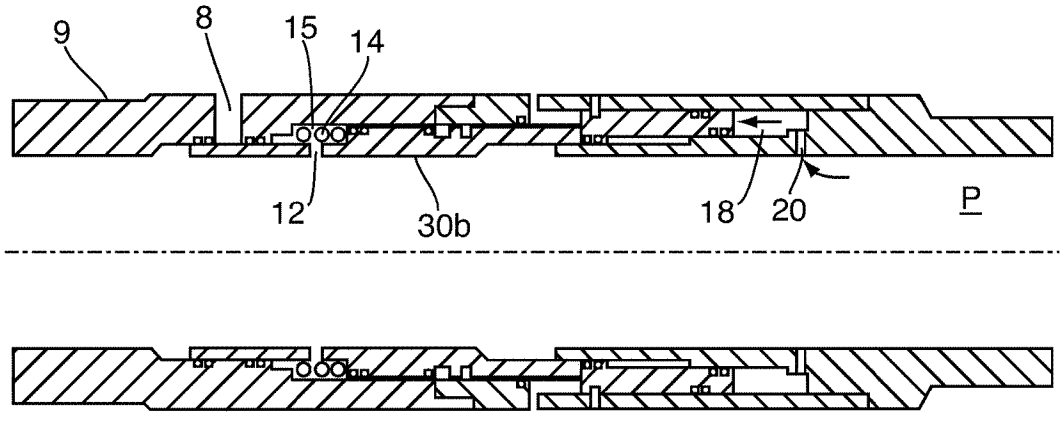
FIG. 8 is one example of a sliding sleeve within the casing for allowing and preventing, when in an open and closed position respectively, oil flowing into the wellbore from the oil production fractures within the formation, showing such sliding sleeve in the closed position.
Figure 9:
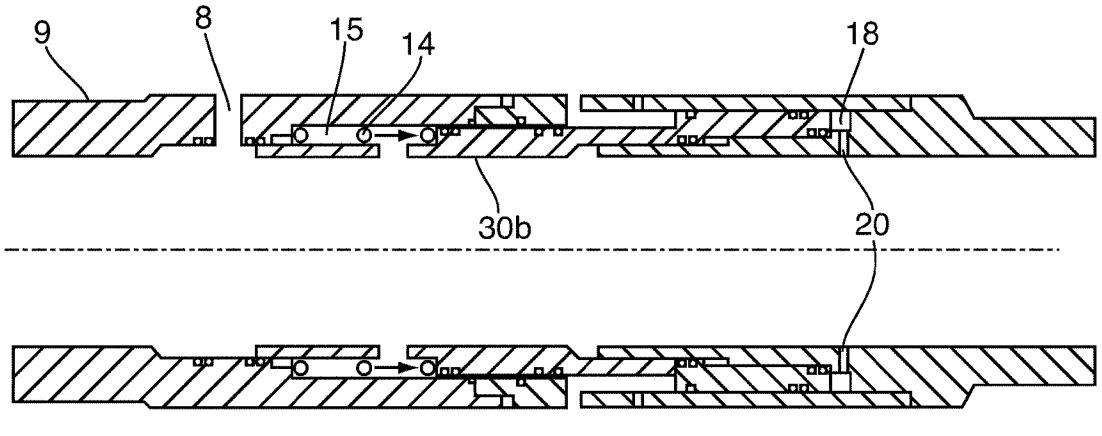
FIG. 9 is a depiction of the sliding sleeve as shown in FIG. 8, but in the open position uncovering a port in the wellbore liner.

Alternatively, sliding sleeves 30*b* may be of the type shown in FIGS. 8 & 9, wherein supply of a high pressure fluid within wellbore lining 9 enters port 20 and cavity 18, causing compression of spring 15 in cavity 14 and movement of sliding sleeve 30*b* to cover port 8 thereby shutting in oil production fractures 40*b* from fluid communication, as shown FIG. 8 and in FIG. 1.

Injectant fluid 70, under relative pressure $\Delta P$, can then be supplied to fluid injection fractures 40*a* for a time sufficient to pressure up formation 1 by injectant fluid 70 driving oil and associated hydrocarbons in such formation 1 towards alternatingly spaced oil production fractures 40*b*.

Thereafter, at a time when formation 1 has become sufficiently pressured up, the supply of injectant fluid to wellbore 9 and fluid injection fractures 40*a* is ceased. Cessation of fluid pressure in wellbore 9, if sliding sleeves 30*b* are of a type shown in FIG. 9, by operation of spring 14 in cavity 15, causes sliding sleeves to then be moved so as to uncover associated ports 8 thereby allowing oil to flow from the hydrocarbon formation 1 into wellbore 9 via oil production fractures 40*b* so as to then be capable of being flowed to surface 4 via wellbore 9. Alternatively, sliding sleeves 30*b*, if not of the type shown in FIGS. 8, 9 and requiring physical manipulation, may likewise be moved to the open position by the same actuation tool inserted down the wellbore 9 to close sliding sleeves 30*a*, to then allow the wellbore 9 to receive oil from oil production fractures 40*b*.

Thereafter, upon the rate of recovery of oil 72 from wellbore 9 falling off as oil is produced, the above method may be repeated, so as to re-pressure the formation 1 and again drive additional oil and hydrocarbons to oil production fractures for subsequent recovery.

FIGS. 3 & 4 show another embodiment of the above method, wherein as shown in FIG. 3 the initial opening of ports 7 allowing supply of injectant fluid to fluid injection fractures 40*a* and the initial shutting-in of oil production fractures 40*b*, is accomplished by initially positioning a sliding sleeve 30 having ports 30*a*' and 30*b*' therein in a first position allowing fluid communication between wellbore 9 and fluid injection fractures 40*a* via ports 30*a*' therein, and simultaneously isolating oil production ports 40*b* by preventing from fluid communication by closing ports 30*b*' and thereby preventing fluid communication with wellbore 9.

To transition to the oil recovery phase of the Intermittent Recovery Process of the present invention, sleeve 30 is slidably moved (via an actuation tool as described above being inserted downhole) to a second position, as shown in FIG. 4, wherein sliding sleeve 30 then prevents fluid communication via ports 30*a*' therein with fluid production channels 40*a* but allows fluid communication of oil production channels 40*b* with wellbore 9 via ports 30*b*' therein.

Figure 5:
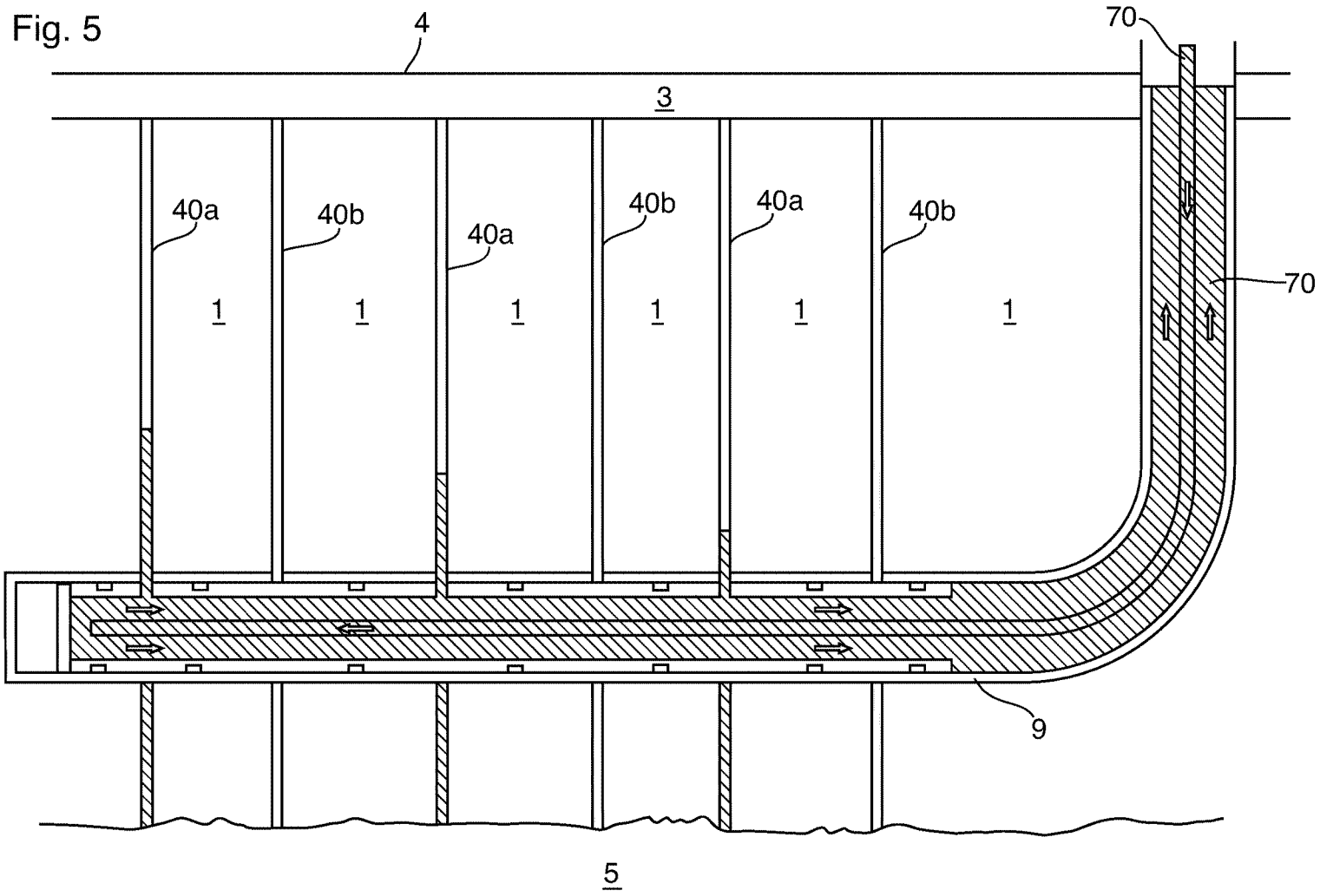
FIG. 5 is a schematic diagram depicting a further optional step in any of aforementioned methods of the present invention, wherein after producing for a time oil from the alternatingly-spaced oil production fractures, a coiled tubing may be inserted to the toe of the wellbore and a flushing fluid injected via said coil tubing into the toe of the wellbore to thereby flush oil within the wellbore and recover same to surface, prior to injecting the injection/driving fluid in the wellbore for injection into the alternatingly-spaced fluid injection fractures.

FIG. 5 shows an optional additional step in the method of the present invention, wherein after completion of the oil production phase (FIG. 2, FIG. 4, FIG. 7, FIG. 11 & FIG. 13) but prior to the re-injection of fluid injection phase (FIG. 1, FIG. 3, FIG. 6, FIG. 10 & FIG. 12), residual oil remaining in wellbore 9 is flushed by injecting the injectant fluid 70 at the toe 80 of the wellbore 9 via a coil tubing 82 extending to toe 80, and re-producing such injectant fluid back to surface 4. In such manner residual oil is produced to surface 4, rather than being intermingled with injection fluid 70 and being re-injected into formation 1 during the subsequent fluid injection phase.

Each of the embodiment shown in FIGS. 1 & 2 and the embodiment shown in FIGS. 3 & 4 employ a shut-in means such as sliding sleeves 30*a*, 30*b* shown in FIG. 1, 2 or a single sliding sleeve 30 having ports 30' thereon as shown in FIGS. 3 & 4, for shutting in (when desired) each of the associated fluid injection fractures 40*a* and oil production fractures 40*b*, respectively, and preventing fluid communication of each with wellbore 9.

It is not necessary, however, in order to practice the method of the present invention, for there to be installed sliding sleeves 30*a*, 30*b* or a single sliding sleeve 30 to regulate fluid communication between both the fluid injection fractures 40*a* and the oil production fractures 30*b*.

Figure 6:
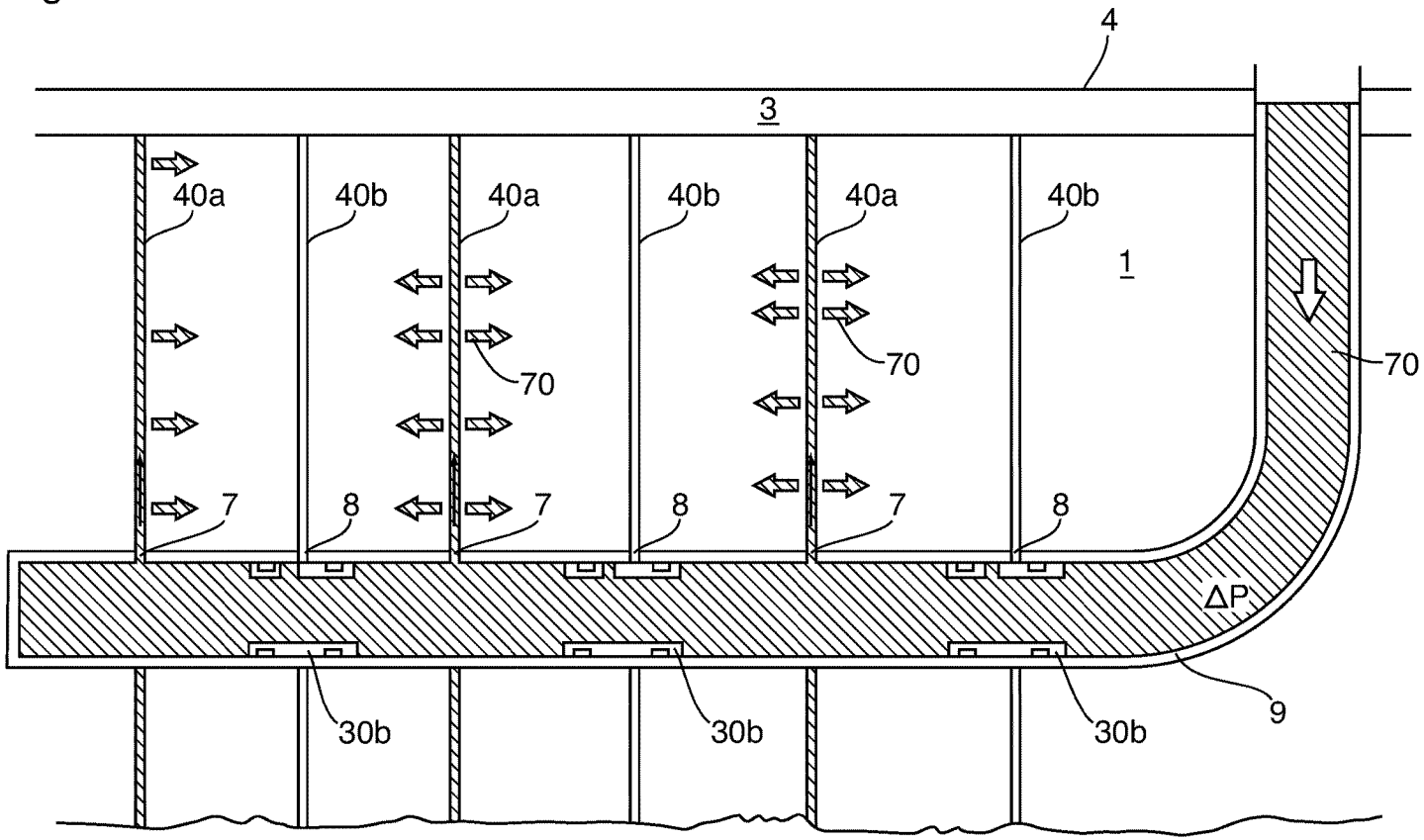
FIG. 6 is a schematic diagram depicting an initial step in another embodiment of the method of the present invention, which method employs a series of sliding sleeves regulating fluid communication only between the wellbore and the oil production fractures, wherein the sliding sleeves are initially in the closed position preventing injection of injection fluid into the oil production fractures and wherein such injected fluid supplied to the wellbore flows into the fluid injection fractures.
Figure 7:
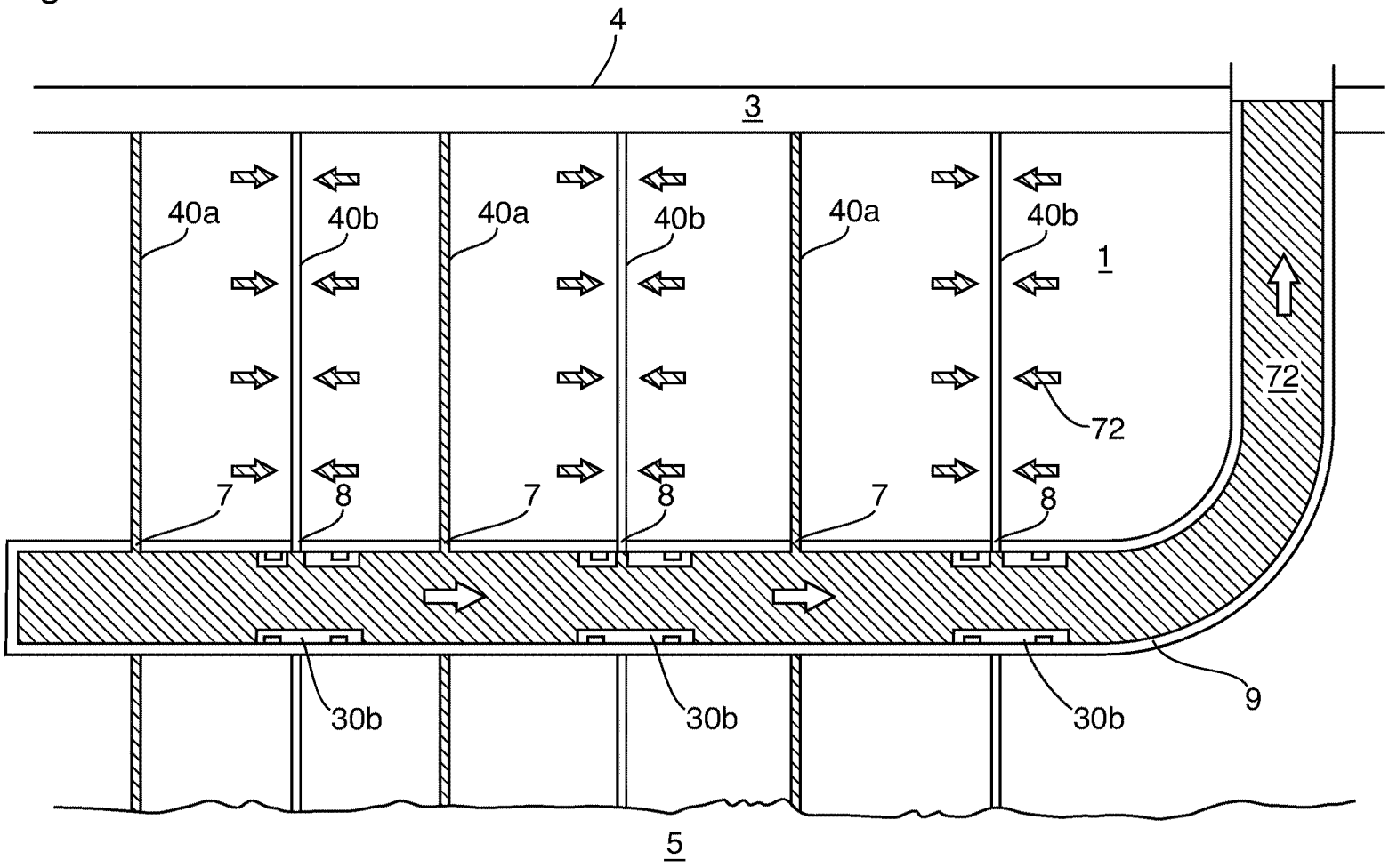
FIG. 7 is a schematic diagram of the embodiment of the method shown in FIG. 10, wherein supply of injection fluid to the wellbore has been ceased, and the sliding sleeves have now been moved to the open position and oil is flowing into the wellbore from the oil production fractures and being produced to surface.

Rather, in a further embodiment of the method of the present invention, as shown in FIG. 6 (fluid injection) & FIG. 7 (oil production), sliding sleeves 30*b* or a sliding sleeve 30 may simply be provided to regulate flow of fluid only through ports 8 in lined wellbore 9 so as to thereby only regulate fluid communication of the oil production fractures 40*b* with the wellbore 9.

No regulation of fluid communication of wellbore fluids with fluid injection fractures 40*a* in this particular method is thus required.

In such embodiment/method, sliding sleeves 30*b* or sliding sleeve 30 may be of the type which are opened/closed by means of an actuation tool (not shown).

Alternatively, sliding sleeves 30*b* may be of the type as shown in FIGS. 8, 9 wherein when fluid injectant under a fluid pressure P is supplied to wellbore 9 associated sliding sleeves 30*b* are caused to move in the manner described above so as to cover ports 8 and thereby prevent injectant fluid being injected into oil production fractures 40*b*. In such manner the injectant fluid is only supplied via the open ports 7 in wellbore liner 9 to the fluid injection fractures 40*a* during the pressure-up phase of the method.

Upon cessation of the first pressuring-up phase of this refined method, and the transition to the second blow-down phase wherein supply of pressurized injectant fluid 70 is ceased, such absence of pressure causes springs 14 (ref. FIG. 9) to return sliding sleeve to an open position uncovering port 8 in wellbore liner 9, thereby allowing oil 72 to flow into wellbore 9 via oil production fractures 40*b* and be produced to surface 4.

The multiple sliding sleeves 30*a*, 30*b* (FIGS. 1, 2) and the single sliding sleeve 30 of FIG. 3, 4, and the further single series of sliding sleeves 30*b* of FIGS. 6 & 7 regulating fluid communication only with oil production fractures 40*b*, are all simply one manner of isolating respectively at least the oil production fractures 40*b* from wellbore 9 when injecting injectant fluid 70.

The present invention further embodies and encompasses methods of intermittently and repeatedly pressuring up and blowing down a reservoir, in the manner described herein, without using a sliding sleeve or sleeves.

In this regard, FIGS. 10-11 and FIGS. 12-13 each show two further alternative embodiments of the method 100 of the present invention where no sliding sleeves are used, and instead a series of packer 25 are used to effect isolation of the oil production fractures 40*b* from the fluid injection fractures 40*a*.

Figure 10:
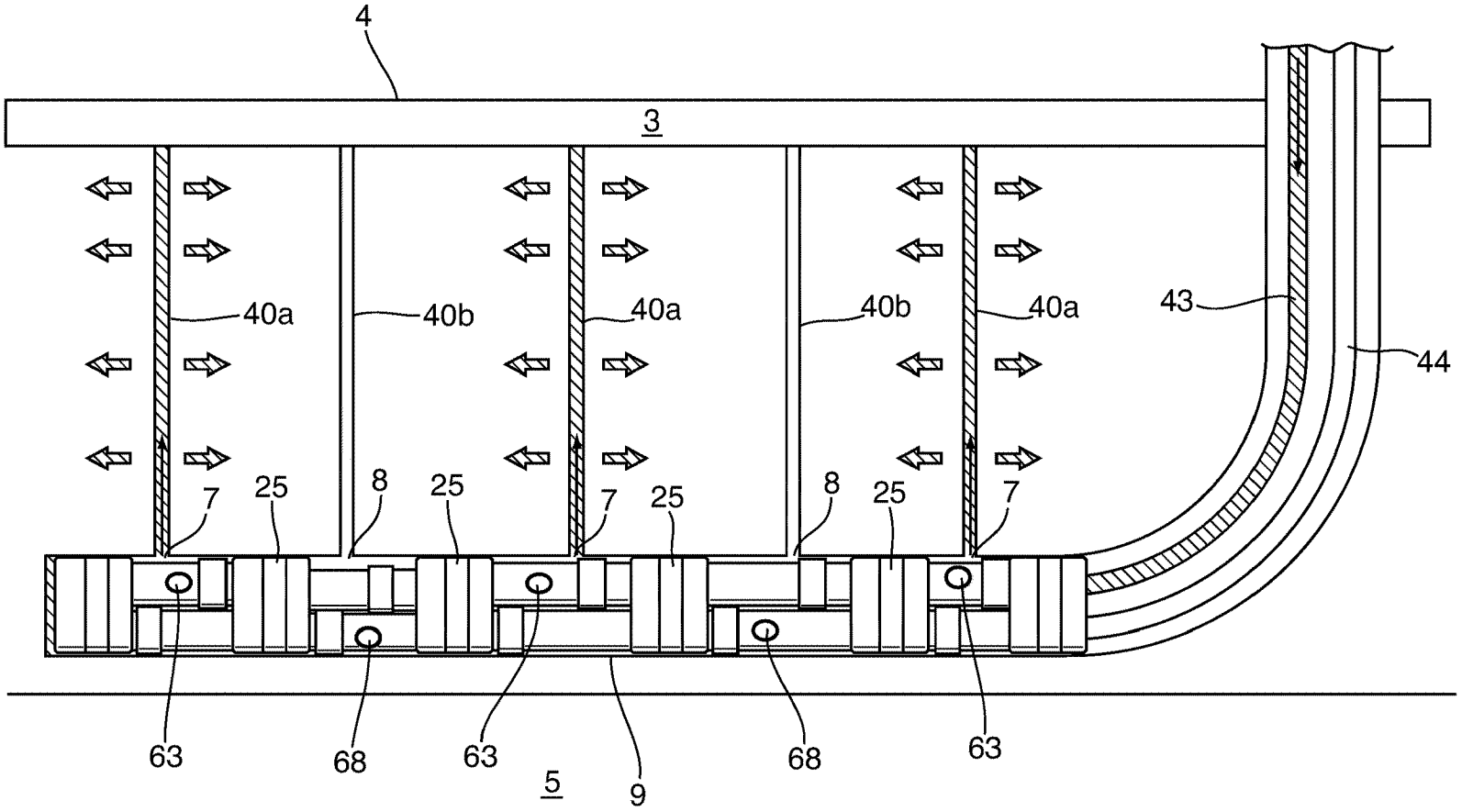
FIG. 10 is a schematic diagram depicting an initial step in another embodiment of the method of the present invention which employs a series of packers and two separate and distinct coil tubings, wherein a fluid injectant is supplied via a first tubing to alternatingly-spaced of the multiple induced injection fractures isolated from remaining alternately-spaced fractures.
Figure 11:
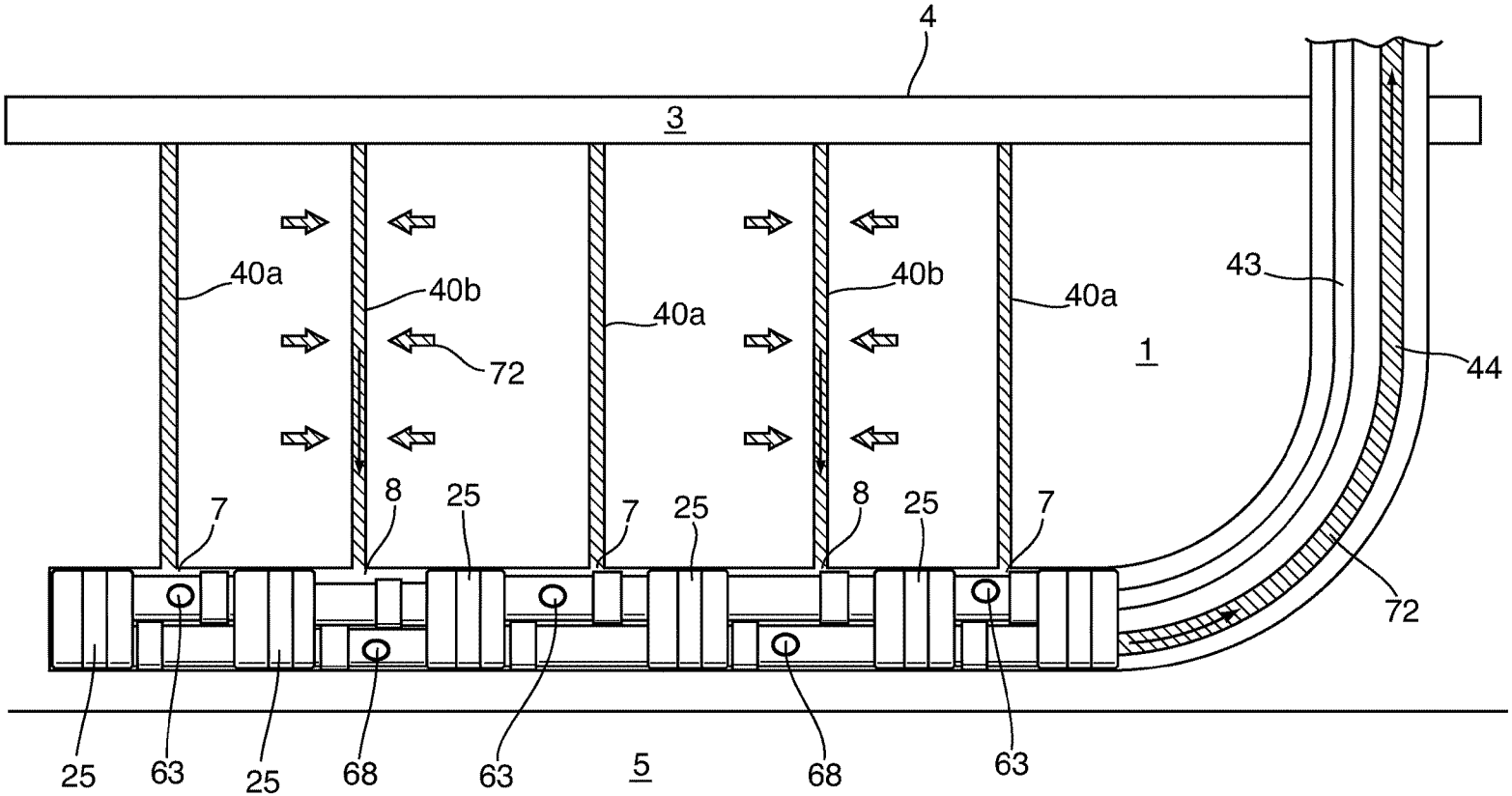
FIG. 11 is a schematic diagram depicting a subsequent step in the Intermittent Fracture Flooding process of FIG. 10, wherein supply to fluid injectant via the first tubing is halted, and oil is allowed to flow from remaining alternating fractures into the second of the coil tubing, and produced to surface.

FIGS. 10 & 11 show a method using a series of (preferably expandable) packer elements 25 through which separate dual tubing, namely a fluid injectant coil 43 and a separate oil production coil 44 passes. As seen from FIG. 10 (the initial fluid injectant phase of the method), the packer elements 25 and coils 43, 44 are placed downhole in lined wellbore 9, with packer elements 25 on opposite sides of ports 7 and 8 along wellbore liner 9. Injectant fluid is first injected into coil 43, and flows out apertures 63 and thus into fluid injection fractures 40*a* via ports 7 in wellbore liner 9.

Upon pressuring up of formation, injection of injectant fluid 70 is ceased (FIG. 11). Thereafter, as seen from FIG. 11 (i.e. the second production phase of the method), produced oil 72 flows into ports 68 in coil 44 via ports 8 in lined wellbore 9, and is produced to surface 4. Upon the rate or quantity of oil 72 from formation 1 dropping below a predetermined rate, the aforementioned steps are again repeated.

Figure 12:
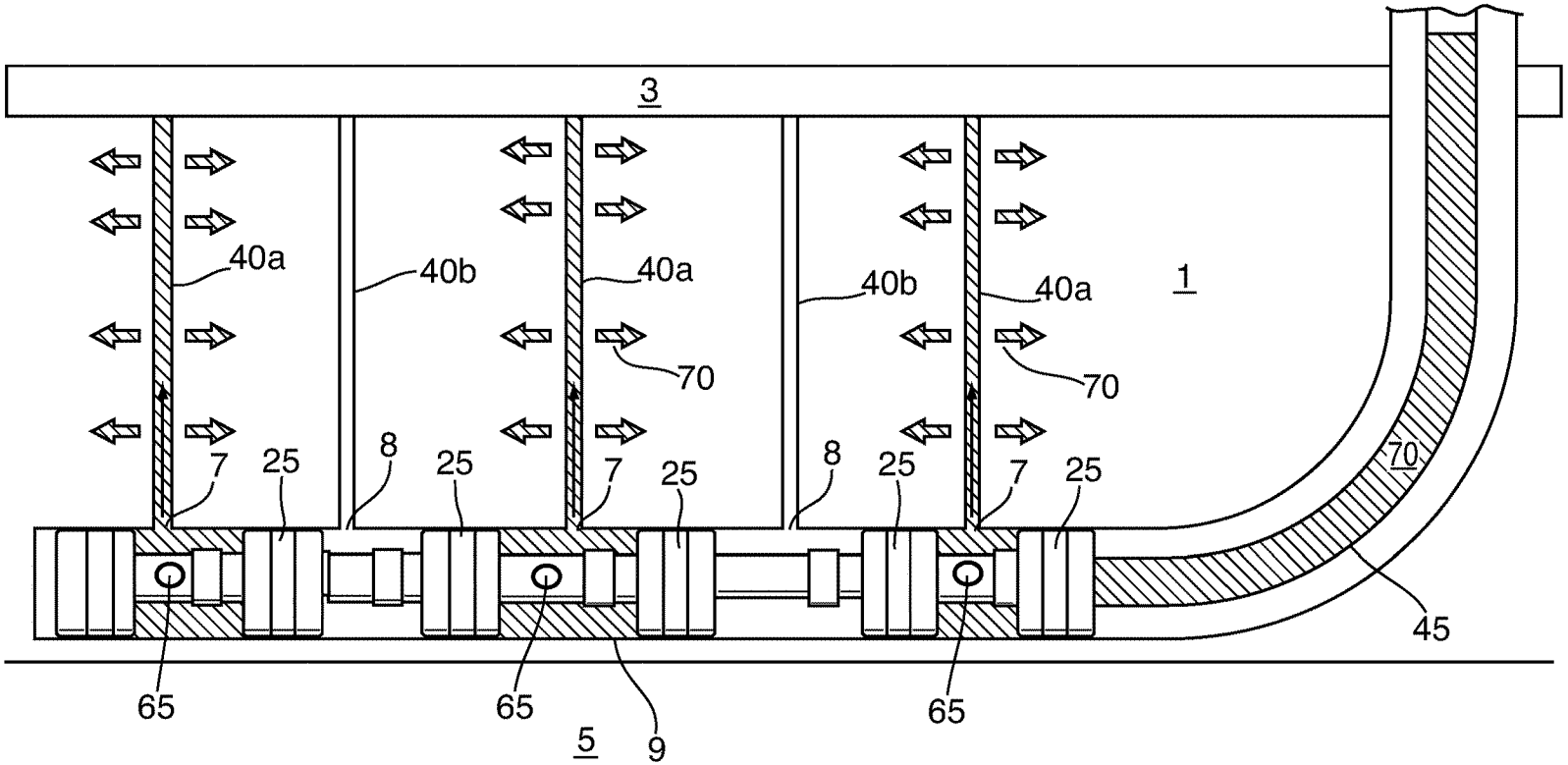
FIG. 12 is a schematic diagram of the initial fluid injection step in another embodiment of the method of the present invention, which employs a series of packers and a single coil tubing, wherein a fluid injectant is supplied via the coil tubing to areas bounded by a series of packers and thus into the fluid injection fractures, and oil production fractures are shut-in/isolated.
Figure 13:
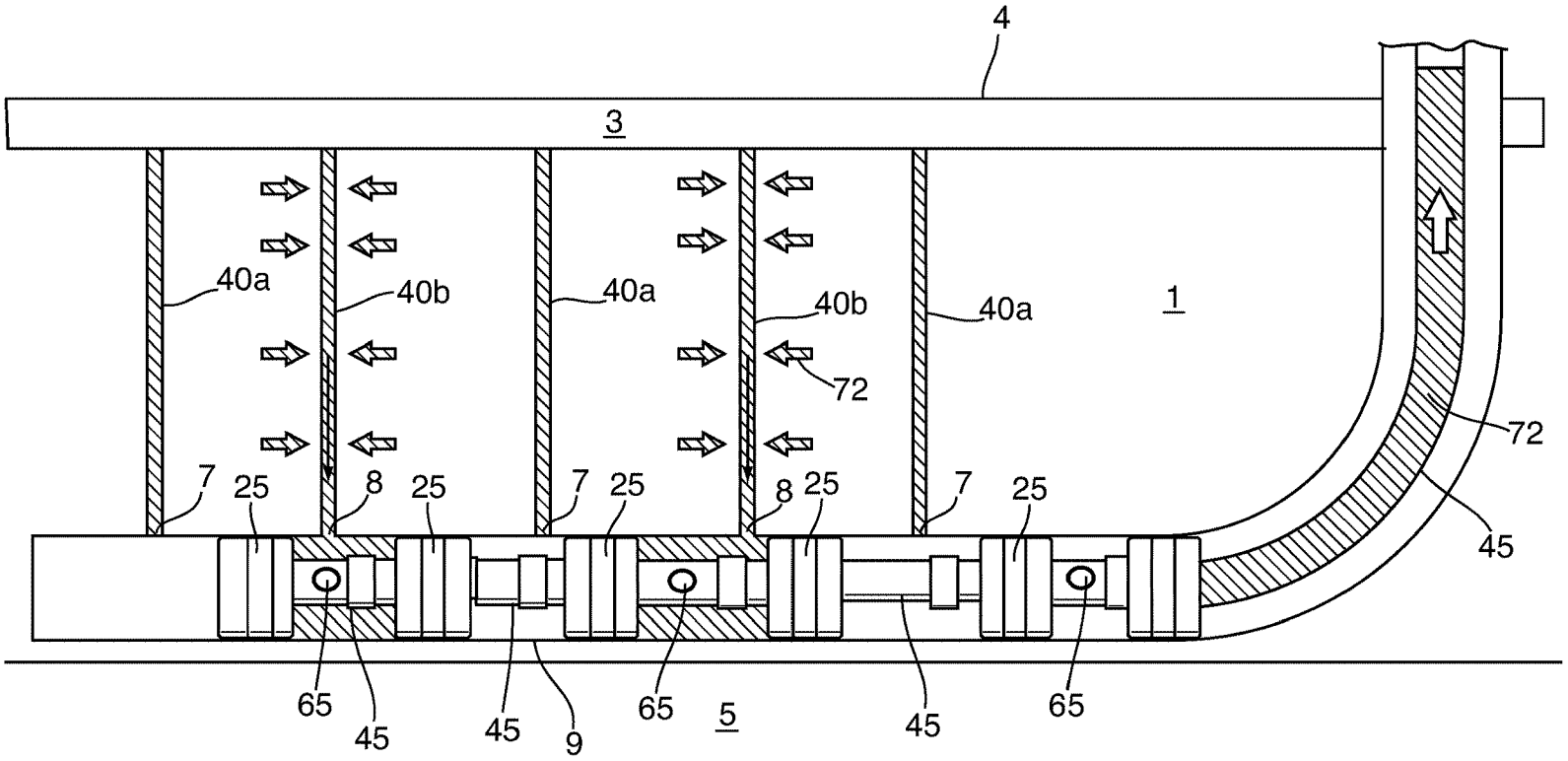
FIG. 13 is a schematic diagram of the subsequent oil production step in the method of FIG. 12, wherein the coil tubing and packers are move slightly uphole (or downhole) to thus align apertures in the coil tubing (and intermediate the packers) with the oil production fractures, and shut in the fluid injection fractures.
Figure 14:
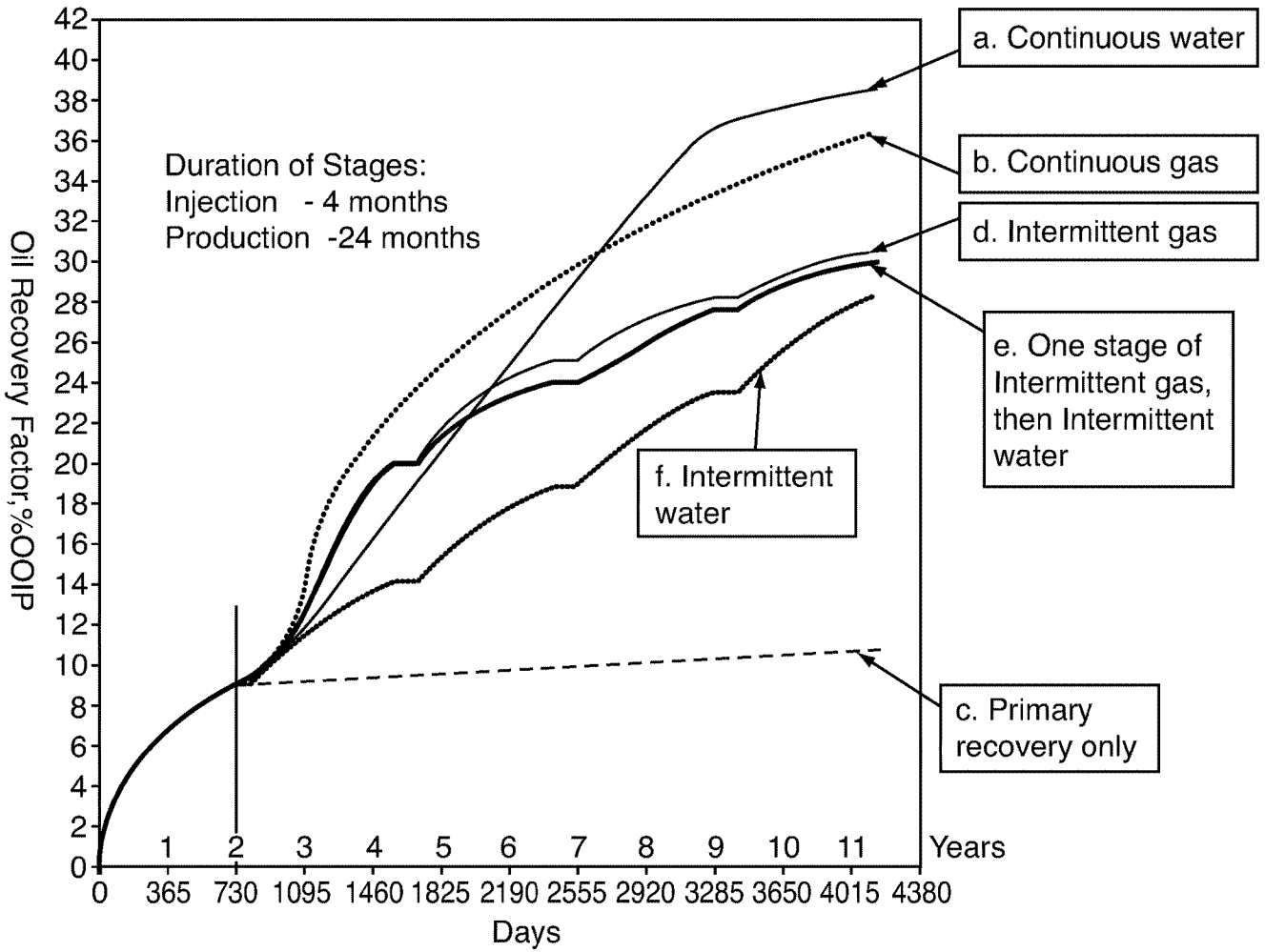

FIGS. 12 & 13 similarly show another method using a series of (preferably expandable) packer elements 25 through which passes a single coil 45, which single coil 45 is alternately used first as a fluid injectant conduit and subsequently as an oil production conduit. No sliding sleeves are needed in this embodiment.

As seen from FIG. 12 (the initial fluid injectant phase of the method), the packer elements 25 and single coil 45 are initially run downhole in lined wellbore 9, with packer elements 25 positioned along the lined wellbore 9 on opposite sides of ports 7 and 8 along wellbore liner 9.

As seen from FIG. 12, injectant fluid is first injected into coil 45 and flows out apertures 65 therein and thus into fluid injection fractures 40*a* via ports 7 in wellbore liner 9.

After a time and upon pressuring up of formation 1, injection of injectant fluid 70 is ceased.

The series of packer elements 25 and coil 45 are together pulled slightly uphole, to now align apertures 65 in coil 45 with ports 8 in lined wellbore 9, thereby allowing oil 72 to flow into ports 65 in coil 45, and thereafter is produced to surface 4.

EXAMPLES

Example 1

Gas was employed as the injection fluid for all four stages, as described below.

A first stage comprising a primary depletion stage of 2 years and a period of 4 months where gas was injected into the formation.

Specifically, after a period of 2-years of primary depletion, and with reference to FIGS. 1 & 2, sliding sleeves 30*b* were closed, isolating associated oil production fractures 40*b* from the horizontal wellbore 9. Then the sliding sleeves 30*a* were opened and gas (methane) was injected into the wellbore 9 from the surface 4, which gas entered thus-opened fluid injection fractures 40*a* and penetrated the adjacent reservoir matrix 5, thus moving oil forward and pressurizing the reservoir 6 to a target maximum value, limited so as to not fracture the rock further. After 4-months of injection, when the gas injection rate had fallen to a pre-determined minimum, injection is deemed complete and fluid injection fractures 40*a* were shut-in by closing associated sliding sleeves 30*a*, while the oil production fractures 40*b* were opened to the wellbore 9 by moving sliding sleeves 30*b* to the open position, for a period of 2-years.

The second stage (stage 2) was begun by closing sleeves 30*b* thereby isolating the oil production fractures 40*b*, and opening sliding sleeves 30*a* to allow fluid communication between wellbore 9 and fluid injection fractures. For a brief period, the fluid injection fractures 30*a* were produced through sleeves 30*a* into the wellbore 9 and to surface 4 in order to flush the wellbore 9 of production fluids. Thereafter, gas was injected into the fluid injection fractures 40*a* via wellbore 9 for a period of 4 months. Sliding sleeves 30*a* were subsequently closed thereby isolating the associated fluid injection fractures 40*a*, followed by opening of sleeves 30*b* to allow oil to flow into wellbore 9 via oil production fractures 40*b* now opened to fluid communication with wellbore 9, to allow wellbore to produce and flow such oil to surface 4.

The above procedures of stage 2 were repeated for two more stages (stages 3 & 4), with stages 3 & 4 each being a successive iteration of above stage 2.

Example 2

The procedures of Example 2 were the same as for Example 1, except that the injection fluid was gas for the first stage and water for the next 3 stages.

Example 3

The procedures of Example 3 were the same as for Example 1, except that the injectant was water for all stages.

Numerical Simulations of Examples 1-3 and Additional Examples for Comparative Purposes In order to demonstrate the efficacy of the intermittent injection methods of the present invention over the prior art, six (6) cases of numerical simulations were conducted using the Computer Modelling Group's STARS reservoir modeling software starting with a standard CMG model as modified, with the parameters of Table 1.

Above Examples 1-3 were simulated using the above computer modelling software, as well as three (3) prior art cases: primary recovery, continuous gas injection, and continuous water injection, using the software parameter inputs and conditions set out in Table 1 below:

TABLE 1

Numerical simulation parameters

| | Value | Units |
|---|---|---|
| Reservoir | | |
| Temperature | 73 | Degree Celsius |
| pressure | 17,000 | kPa |
| Maximum safe injection pressure | 23,000 | kPa |
| Horizontal permeability | 0.50 | mD |
| Vertical permeability | 0.05 | mD |
| Oil saturation | 50 | % |
| Water saturation | 50 | % |
| Fracture permeability | 2000 | mD |
| Oil density | 45 | Degree API |
| Gas-oil-ratio | 64 | Dissolved in oil |
| Model Parameters | | |
| Grid block size, I, j, k | 1, 5, 1 | meters |
| Number Grid blocks, I, j, k (¼ element of symmetry) | 200, 10, 40 | number |
| Full model volume | 1.6E06 | Cubic meters |
| Bottom-hole pressure | 100 | kPa |

A generic "tight" reservoir having light oil (Oil density of 45° API) was assumed, and the model employed an element of symmetry representing ¼ of the affected reservoir.

For all simulations, the reservoir was first produced under primary production for 2-years. Then 4-stages of injection and production were conducted. The injection periods were 4-months duration and the production periods were 2-years duration. This is not to limit the possible injection or production intervals, which will depend upon the availability of injection fluids, the spacing of the fractures, the fluid injection rates, reservoir permeability and other factors familiar to those knowledgeable in the art. The present Intermittent Fracture Flooding Process can be applied at any time during the life of the well, including at start-up.

The results of the aforesaid simulated scenarios are graphically displayed in FIG. 6.

In a preferred embodiment of the method of the present invention and referring to line e) in FIG. 6, a first stage of gas injection is conducted because this provides the largest increase in oil rate and oil recovery factor relative to the primary recovery factor.

However, as may be seen from FIG. 6, in subsequent stages the advantage of gas injection over water injection is only slight [cf. line 'a' as compared to line 'b', respectively)] and indeed in later stages water injection has a higher oil recovery factor. Accordingly, since gas compression costs are considerably higher than for water injection with a pump, it is more economical to switch to water injection after the first stage.

In a more preferred embodiment, the option of miscible gas injection for all stages can be undertaken. This can be accomplished with the produced fluids in at least two ways. Firstly, the produced gas can be re-cycled to establish multiple-contact miscibility, and secondly, the produced light oil (e.g. Bakken oil: 42 degrees, 7.2% C2-C5) can be heated to an appropriate temperature, and/or subjected to decreased pressure to provide light hydrocarbons to the re-injected gas, so that a miscible injection gas flood can be established faster or even immediately.

While it might seem imprudent to deliberately flash off some of the oil product, it should be recalled that light tight oil from the Bakken and Eagle Ford formation is problematic from the perspective of shipping safety as demonstrated by at least two recent devastating rail car explosions that were attributed to the high Reid vapor pressure of oil from those formations. The removal of light components from the sales oil would reduce the oil vapor pressure and improve transportation safety. In a further embodiment the Intermittent Fracture Flooding Process can also be enhanced by including within the horizontal well pressure-equalizing equipment such as a perforated injection and production tubing with holes strategically designed to equalize pressure within the annular space.

The above description of some embodiments of the present invention is provided to enable any person skilled in the art to make or use the present invention.

For a complete definition of the invention and its intended scope, reference is to be made to the summary of the invention and the appended claims read together with and considered with the detailed description and drawings herein on a purposive interpretation thereof.

I claim:

1. A method for sweeping oil from a hydrocarbon formation having a plurality of fractures therein extending radially outwardly from a wellbore therein using a single slidably-movable sleeve member, using an intermittent pressure-up blow-down procedure, comprising the steps of:

(i) providing a substantially-horizontal wellbore within said hydrocarbon formation, said wellbore having therein a hollow cylindrical liner;

(ii) providing a plurality of multiple induced fractures extending substantially radially outwardly from said horizontal wellbore, said multiple induced fractures contacting said wellbore and liner at spaced-apart points of contact and at correspondingly-spaced perforations in said liner;

(iii) providing a single elongate hollow sleeve member longitudinally slidably moveable within said liner, said sleeve member having at least one aperture in an outer periphery thereof in communication with a hollow interior of said sleeve member;

(iv) slidably moving said hollow sleeve member within said lined wellbore so as to align said at least one aperture therein with alternating of said multiple induced fractures so as to allow fluid communication with said wellbore and simultaneously prevent fluid communication between said wellbore and remaining of said multiple induced fractures by obstructing said remaining multiple induced fractures;

(v) injecting an injection fluid into the hollow sleeve member and causing said injection fluid to flow into said alternating of said multiple induced fractures for a period of time to thereby pressure-up the formation;

(vi) slidably moving said hollow sleeve member and said at least one aperture therein within said lined wellbore so as to then re-align said at least one aperture with remaining of said multiple induced fractures;

(vii) collecting, within said slidable sleeve member, oil which drains downwardly from said remaining of said multiple inducted fractures into said wellbore, and recovering said oil to surface; and (viii) successively additionally repeating each of steps (iv)-(vii) one or more times.

2. The method as claimed in claim 1, wherein:

step (ii) comprises providing said plurality of multiple induced fractures along said wellbore at uniformly spaced-apart points of contact with said wellbore and liner;

step (iii) comprises providing a single elongate hollow sleeve member having a plurality of uniformly spaced-apart apertures therein, longitudinally spaced therealong in a spacing corresponding to spacing of alternating of said multiple induced fractures;

step (iv) comprises slidably moving said hollow sleeve member within said liner so as to align said plurality of uniformly spaced-apart apertures therein with alternating of said multiple induced fractures;

step (v) comprises injecting an injection fluid into the lined wellbore and hollow sleeve member and causing said injection fluid to flow into said alternating of said multiple induced fractures for a period of time to thereby pressure-up the formation, said alternating of said multiple inducted fractures when injected with said fluid comprising fluid injection fractures;

step (vi) comprises slidably moving said hollow sleeve member and apertures therein within said lined wellbore so as to then re-align said spaced-apart apertures on said slidable sleeve member with remaining of said multiple induced fractures so as to form oil production fractures now aligned with said spaced-apart apertures on said hollow sleeve member;

step (vii) comprises collecting, within said slidable sleeve member, oil which drains downwardly from said oil production fractures into said wellbore and recovering said oil to surface.

3. The method as claimed in claim 2, wherein said perforations in said liner at said points of contact with said fluid injection fractures and said oil production fractures have a larger cross-sectional area proximate a toe of said wellbore as compared to cross sectional area of perforations in said liner more proximate a heel of said wellbore.

4. The method as claimed in claim 1, wherein said slidable sleeve is positioned on or coupled to the distal end of coiled tubing.

5. The method as claimed in claim 1, wherein said steps (v)-(vii) are initially conducted using a gas as the injection fluid, and successive iterations of steps (v)-(vii) are carried out using water as the injection fluid.

6. The method as claimed in claim 1, wherein method is carried out over a portion of a length of said lined wellbore.

7. The method as claimed in claim 1, wherein said step of re-aligning said hollow sleeve member in step (vi) is carried out by insertion downhole of a tool at the distal end of coil tubing, which upon actuation allows displacement of said sliding sleeve member.

8. The method as claimed in claim 1, comprising the further step after step (vii) but prior to commencing or recommencing step (v), of flushing oil remaining in said lined wellbore from the lined wellbore by draining said injection fluid in said alternating of said multiple induced fractures into said wellbore, and producing said fluid and any remaining oil in said wellbore to surface.

9. The method as claimed in claim 1, comprising the further step, prior to commencing or recommencing step (v), of flushing oil remaining in said lined wellbore from the lined wellbore by injecting said injection fluid at a toe of said horizontal portion via a tubing in said lined wellbore extending to said toe thereof, and producing same to surface.

10. The method as claimed in claim 1, wherein the injection fluid is a gas.

11. The method as claimed in claim 10, wherein said gas is miscible in oil.

12. The method as claimed in claim 1, wherein the injection fluid is a gaseous fraction which is obtained from said produced oil.

13. The method as claimed in claim 12, wherein said gas fraction is obtained from said produced oil by subjecting said produced oil to increased temperature and/or reduced pressure, to thereby flash volatile gaseous components within said produced oil for use of such volatile gaseous components as the injection fluid.

14. The method as claimed in claim 12, wherein the gas fraction is enriched in C2-C5 components.

15. The method as claimed in claim 1, wherein the injection fluid comprises a gas selected from the group of gases consisting of natural gas, gases contained within and obtained from said produced oil, CO2, and mixtures thereof.

16. The method as claimed in claim 1, wherein a portion of oil which is produced in accordance with one or more of such methods is heated and used to flash volatile gaseous components therein to thereby provide additional gaseous components to the injected fluid.

17. The method as claimed in claim 1, wherein the injected fluid is water with or without chemical additives.

18. The method as claimed in claim 1, wherein the injected fluid includes both water and gas.

19. The method as claimed in claim 1, wherein the wellbore is a vertical, slant or horizontal wellbore.

20. The method as claimed in claim 1, wherein said method is first commenced at any time in a lifecycle of a completed hydrocarbon reservoir.

21. The method as claimed in claim 1, said injecting of said injection fluid and pressuring up said formation in step (v) is carried out over a period extending from one day to 1 year.

22. The method as claimed in claim 1, wherein said period of time in step (vii) for said recovering of said produced fluids is carried out over a period extending from one month to 10 years.

23. The method as claimed in claim 1, wherein fluid pressure within said lined wellbore is equalized over its length.

24. The method as claimed in claim 1, wherein injection of said fluid and production of said oil are accomplished via flow thereof through a perforated liner inserted within and extending substantially over a horizontal length of said portion of the wellbore, said perforated liner having perforation patterns therein configured so as to equalize fluid pressure differential applied to said multiple induced fractures over a length of said wellbore.

25. The method as claimed in claim 1, wherein the injected fluid is water with or without chemical additives.

26. The method as claimed in claim 1, wherein the injected fluid includes both water and gas.

27. An intermittent pressure-up, blow-down method to recover oil from an underground hydrocarbon formation having a wellbore and having multiple induced fractures extending radially outwardly from said wellbore and longitudinally spaced along a portion of a length of said lined wellbore, using a single elongate hollow sliding sleeve member having a plurality of apertures therein longitudinally spaced along a length of said hollow sleeve member, comprising the steps of:

(i) providing a liner within said wellbore having perforations therein aligned with said multiple inducted fractures along said wellbore;

(ii) slidably moving said elongate hollow sleeve member longitudinally within said lined wellbore, so as to align said apertures in said sleeve member with corresponding alternately spaced of said multiple induced fractures to form a plurality of fluid injection fractures in fluid communication with said wellbore, and simultaneously obstructing perforations in said liner aligned with remaining of said multiple induced fractures spaced along said wellbore so as to form a plurality of oil production fractures which are temporarily prevented from fluid communication with said wellbore;

(iii) injecting an injection fluid into the lined wellbore and causing said injection fluid to flow into said fluid injection fractures for a period of time, to thereby pressure-up the formation;

(iv) slidably repositioning said hollow sleeve member so as to prevent fluid communication between said fluid injection fractures and an interior of said lined wellbore, and simultaneously by said slidable movement allowing fluid communication between said oil production fractures and said interior of said lined wellbore;

(v) collecting oil which flows into said lined wellbore from said oil production fractures, and producing same to surface; and (vi) successively additionally repeating each of steps (i)-(iv) one or more times.

28. The method as claimed in claim 27, wherein said sleeve member is further provided with at least one pair of packers or seal members on respectively mutually opposite sides of each of said plurality of apertures therein.

29. The method as claimed in claim 28, having a further step, subsequent to step (iv) but prior to commencing or recommencing step (ii), of flushing oil remaining in said lined wellbore by injecting said injection fluid at a toe of the horizontal portion via a tubing in said lined wellbore extending to said toe thereof, and producing same to surface.

* * * * *